United States Patent [19]

Bolick, II et al.

[11] Patent Number: 4,793,906

[45] Date of Patent: Dec. 27, 1988

[54] ELECTROCHEMICAL PROCESS FOR PRODUCING HYDROSULFITE SOLUTIONS

[75] Inventors: Roger E. Bolick, II, Chattanooga; David W. Cawlfield; Jimmy M. French, both of Cleveland, all of Tenn.

[73] Assignee: Olin Corporation, Cheshire, Conn.

[21] Appl. No.: 892,518

[22] Filed: Aug. 4, 1986

[51] Int. Cl.[4] ..... C25B 1/14

[52] U.S. Cl. ..... 204/92; 204/263

[58] Field of Search ..... 204/92

[56] References Cited

U.S. PATENT DOCUMENTS

| | | | |
|---|---|---|---|
| 2,193,323 | 3/1940 | Nitzschke et al. | 204/9 |
| 2,273,799 | 2/1942 | Janes et al. | 204/94 |
| 3,523,069 | 8/1970 | Oloman | 204/92 |
| 3,748,238 | 7/1973 | Heit et al. | 204/92 |
| 3,920,551 | 9/1975 | Cook, Jr. et al. | 204/92 |
| 4,144,146 | 3/1979 | Leutner et al. | 204/92 |

FOREIGN PATENT DOCUMENTS

| | | |
|---|---|---|
| 56-87682 | 7/1981 | Japan . |
| 1045675 | 10/1966 | United Kingdom . |

OTHER PUBLICATIONS

Olomon, C., "The Preparation of Dithionites by the Electrolytic Reduction of Sulfur Dioxide in Water", J. Electrochem. Soc.: Electrochemical Technology, Dec. 1970, pp. 1604–1609.

Kovacs, L., S. Muthukumaraswami, S. Krishnamurthy, R. Thangappan & H. V. K. Upuda, "Electrochemical Reduction of Sodium Bisulphite to Sodium Hydrosulphite in a Fluidized Bed Electrode", Journal of Indian Technology, vol. 14, Apr., 1976, pp. 184–188.

Gizetdinova, N. A., "Electrochemical Synthesis of Sodium Dithionite", Siberian Scientific-Research Institute of Paper and Cardboard, Translated from Zhurnal Prikladnoi Khimii, vol. 52, No. 12, pp. 2741–2744, Dec., 1979. Original article submitted Aug. 7, 1978.

*Primary Examiner*—T. Tung

*Attorney, Agent, or Firm*—James B. Haglind

[57] ABSTRACT

A process for the electrochemical production of an alkali metal hydrosulfite by the reduction of an alkali metal bisulfite component of a circulated aqueous catholyte solution in an electrolytic membrane cell having a cathode compartment, a porous cathode in the cathode compartment, an anode compartment and a cation exchange membrane separating the cathode compartment from the anode compartment, which comprises passing at least 30 percent by volume of the aqueous catholyte through the pores of the porous cathode in the cathode compartment.

High purity solutions of alkali metal hydrosulfites, such as sodium hydrosulfite having concentrations of at least 120 grams per liter, are produced at current densities in the range of 1.0 to 4.5 KA/m$^2$ and at reduced cell voltages. The thiosulfate impurity concentration is from 0 to about 10 percent by weight of the hydrosulfite.

10 Claims, 1 Drawing Sheet

ELECTROCHEMICAL PROCESS FOR PRODUCING HYDROSULFITE SOLUTIONS

The present invention relates to an electrochemical process for the mauufacture of aqueous solutions of hydrosulfites. More prrticularly, the present invention relates to the electrochemical production of concentrated hydrosulfite solutions at high current densities.

Many attempts have been made at developing a process for manufacturing alkali metal hydrosulfites such as sodium hydrosulfite or potassium hydrosulfite electrochemically. The electrochemical process for making hydrosulfite results in the reduction of bisulfite ions to hydrosulfite ions. For this process to be economical, current densities must be employed which are capable of producing concentrated hydrosulfite solutions at high current efficiencies.

Further, where the solutions are to be used in the paper industry, the byproduct formation of thiosulfate, an undesirable impurity, from hydrosulfite must be minimized. At high concentrations of hydrosulfite, however, this byproduct reaction becomes more difficult to control.

Additionally, electrochemical routes to hydrosulite produce aqueous solutions which are unstable and decompose at a rapid rate. This high decomposition rate therefore requires that the residence time of solution in the cell be kept low and the current density as high as possible.

Some of the processes of the prior art, which claim to make hydrosulfite salts electrochemically, require the use of methanol to reduce the solubility of the hydrosulfite and prevent its decomposition inside the cell. The costly recovery of the methanol and hydrosulfite makes this route uneconomical.

The use of zinc as a stabilizing agent for hydrosulfites in electrochemical processes has also been reported, but because of environmental considerations, this is no longer practiced commercially.

More recently, U.S. Pat. No. 4,144,146 issued Mar. 13, 1979 to B. Leutner et al describes an electrochemical process for producing hydrosulfite solutions in an electrolytic membrane cell. The process employs high circulation rates for the catholyte which is passed through an inlet in the bottom of the cell and removed at the top of the cell to provide for the advantageous removal of gases produced during the reaction. Catholyte flow over the surface of the cathodes is maintained at a rate of at least 1 cm per second where the cathode has a mesh spacing of 5 mm or less. The process is deccribed as producing concentrated solutions of alkali metal hydrosulfites at commercially viable current densities; however, the cell voltages required were in the range of 5 to 10 volts. There is no indication of the concentrations of thiosulfate impurity in the product solutions.

Therefore, there is a need for an electrochemical process for producing aqueous solutions of alkali metal hydrosulfites having low concentrations of alkali metal thiosulfates as impurities at high current densities and at reduced cell voltages.

It is an object of the present invention to provide an electrochemical process for producing aqueous alkali metal hydrosulfite solutions having low concentrations of alkali metal thiosulfates as impurities.

Another object of the present invention is to provide an electrochemical process for producing concentrated alkali metal hydrosulfites which operates at high current densities.

These and other objects of the invention are accomplished in a process for the electrochemical production of an alkali metal hydrosulfite by the reduction of an alkali metal bisulfite component of a circulated aqueous catholyte solution in an electrolytic membrane cell having a cathode compartment, a porous cathode in the cathode compartment, an anode compartment and a cation exchange membrane separating the cathode compartment from the anode compartment, which process comprises passing at least 30 percent by volume of said aqueous catholyte through the pores of the porous cathode in said cathode compartment.

According to the invention, it has been found that directing the flow of at least 30 percent by volume of the catholyte through the porous cathode to maximize contact between the catholyte and the cathode results in significant improvements in the electrochemical process for producing aqueous alkali metal hydrosulfite solutions.

Figure 1:
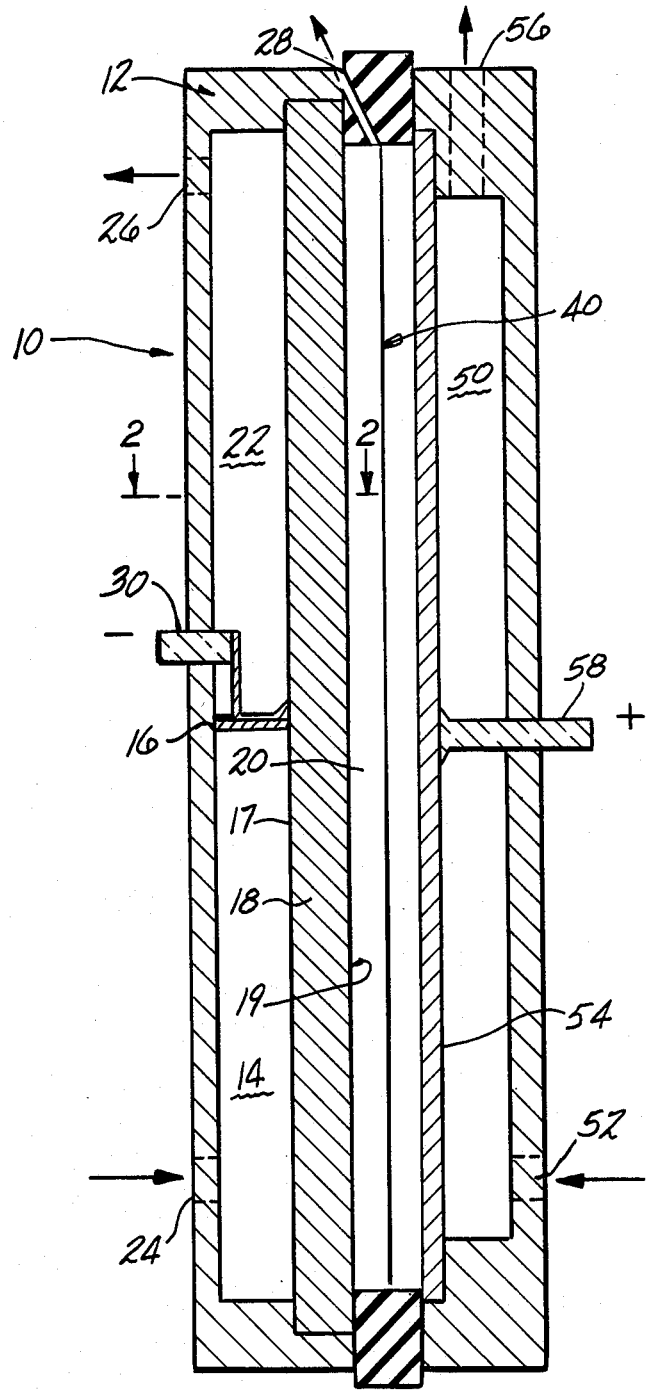
FIG. 1 illustrates a front perspective view of one embodiment of the novel membrane cell of the present invention.

As illustrated in FIG. 1, membrane electrolytic cell 10 has cathode compartment generally signified by 12 and anode compartment 50 separated by membrane 40. Cathode compartment 12 includes first catholyte zone 14, barrier 16, porous cathode 18, cathode-membrane gap 20, and second catholyte zone 22. During cell operation, an electrolyte is fed through inlet 24 into first catholyte zone 14. Barrier 16, positioned behind back 17 of porous cathode 18, serves to prevent or at least minimize the direct flow of electrolyte between first catholyte zone 14 and second catholyte zone 22. Thus at least a portion of the catholyte flows past back 17 of porous cathode 18 through porous cathode 18 and face 19 of porous cathode 18 into cathode-membrane gap 20. Cathode-membrane gap 20 is positioned between face 19 of porous cathode 18 and membrane 40. Catholyte in the cathode-membrane gap 20 flows upwards and back through porous cathode 18 into second catholyte zone 22, and is removed from catholyte zone 22 through outlet 26. Where a gas is produced in cathode compartment 12, it is removed through gas outlet 28. Cathode current conductor 30 is connected to barrier 16 and to back 17 of porous cathode 18. Anode compartment 50 includes inlet 52, anode 54, outlet 56, and anode current conductor 58.

In the novel process of the present invention a buffered aqueous solution of an alkali metal bisulfite is electrolyzed intthe cathode compartment. The alkali metal bisulfite solution, containing at least about 10 grams per liter of $NaHSO_3$, may be produced, for example, by the reaction of an aqueous solution of an alkali metal sulfite with sulfur dioxide gas. While this reaction may be carried out in the cathode compartment, for example, the first catholyte zone, it is preferable to produce the buffered bisulfite solution outside of the cell where careful admixing of the reactants can continuously produce an alkali metal bisulfite solution having a pH within the desired range. From the first catholyte zone, the alkali metal bisulfite solution flows through the porous cathode into the cathode-membrane gap located between the face of the cathode and the membrane. Bisulfite ions are electrolytically reduced to hydrosulfite ions (dithionite ions) while the catholyte solution flows throug the porous cathode, parallel to the membrane and then back through the porous cathode into the second catholyte zone.

In a preferred embodiment of the invention, continuous circulation of the catholyte through the cathode compartment is maintained at rates which minimize the formation of impurities such as alkali metal thiosulfates. Suitable circulation rates are those which prevent a pH change of greater than about 0.5 unit per pass through the cathode compartment. Preferably the pH change is less than about 0.3 unit per pass through the cathode compartment. During the electrolysis, the pH of the aqueous solution is maintained in the range of from about 5.0 to about 6.5, and preferably at about 5.2 to about 6.2, and more preferably at from about 5.5 to about 6.0. The temperature of the catholyte is maintained in the range of from about 0° to about 35° C., depending on the hydrosulfite concentration. Preferably the catholyte temperature is at least 15° C.

The operation of the electrolytic membrane cell described above also results in the control of the pressure drop across the cathode within desirable limits.

During cell operation the barrier means directs at least 30 percent, preferably at least 50 percent, more preferably from at least 70, and even more preferably from about 80 to about 100 percent, by volume of the catholyte through the pores of the porous cathode, that is from the back of the cathode to the face of the cathode and into the cathode-membrane gap.

As noted above and in accordance with the invention, the design of the barrier means can be made to block the flow of catholyte, or to minimize the flow of catholyte between the first and second catholyte zones. Thus the barrier means can-be substantially solid, as illustrated in FIG. 2, or foraminous or non-continuous.

Figure 2:
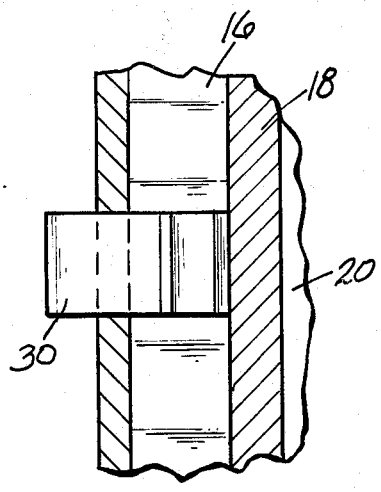
FIG. 2 depicts a schematic partial sectional view of FIG. 1 taken along line 2—2.

Cathode current conductor 30 may be directly connected to the barrier means and the cathode as shown in FIGS. 1 and 2, or separately connected to the cathode.

The alkali metal hydrosulfite solution produced by the novel process of the invention contains commercial concentrations of the alkali metal hydrosulfite, varying concentrations of alkali metal bisulfite and alkali metal sulfite, and has concentrations of from 0 to about 10 percent by weight of alkali metal thiosulfate as an impurity, based on the weight of hydrosulfite.

The anolyte which is electrolyzed in the anode compartment is any suitable electrolyte which is capable of supplying alkali metal ions and water molecules to the cathode compartment. Suitable as anolytes are, for example, alkali metal halides, alkali metal hydroxides, or alkali metal persulfates. The selection of anolyte is in part dependent on the product desired. Where a halogen gas such as chlorine or bromine are wanted, an aqueous solution of an alkali metal chloride or bromide is used as the anolyte. Alkali metal hydroxide solutions are chosen where oxygen gas or hydrogen peroxide is to be produced. If persulfuric acid is the desired product, an alkali metal persulfate is employed. In any case, concentratd solutions of the electrolyte selected are employed as the anolyte. For example, where a sodium chloride is selected as the alkali metal chloride, suitable solutions as anolytes contain from about 17 to about 35 percent by weight of NaCl. Solutions of alkali metal hydroxides such as sodium hydroxide contain from about 5 to about 40 percent by weight of NaOH.

The process of the present invention is operated at current densities which are sufficiently high enough to produce solutions of alkali metal hydrosulfites having the concentrations desired. For example, where sodium hydrosulfite is produced for commercial sale, the solutions contain from about 120 to about 160 grams per liter. However, as the alkali metal hydrosulfite solutions sold commercially are usually diluted before use, these dilute aqueous solutions can also be produced directly by the process. The novel electrochemical process is normally operated continuously but may be operated in a non-continuous or batchwise manner.

Current densities of at least 0.5 kiloamps per square meter are employed. Preferably the current density is in the range of from about 1.0 to about 4.5, and more preferably at from about 2.0 to about 3.0 kiloamps per square meter.

At these high current densities, the novel process of the present invention operates to produce high purity alkali metal hydrosulfite solutions which can be employed commercially without further concentration or purification.

The electrolytic membrane cell used in the process of the present invention employs, as a separator between the anode and the cathode compartments, a cation exchange membrane which prevents any substantial migration of sulfur-containing ions from the cathode compartment to the anode compartment. A wide variety of cation exchange membranes can be employed containing a variety of polymer resins and functional groups.

Employed are cation exchange membranes which are inert, flexible membranes, and are substantially impervious to the hydrodynamic flow of the electrolyte and the passage of gas products produced in the cell. Cation exchange membranes are well-known to contain fixed anionic groups that permit intrusion and exchange of cations, and exclude anions, from an external source. Generally the resinous membrane or diaphragm has as a matrix, a cross-linked polymer, to which are attached charged radicals such as $—SO_3^-$, $—COO^-$, $—PO_3^=$, $—HPO_2^-$, $—AsO_3^=$, and $—SeO_3^-$ and mixtures thereof. The resins which can be used to produce the membranes include, for example, fluorocarbons, vinyl compounds, polyolefins, and copolymers thereof. Preferred are cation exchange membranes such as those comprised of fluorocarbon polymers having a plurality of pendant sulfonic acid groups or carboxylic acid groups or mixtures of sulfonic acid groups and carboxylic acid groups. The terms "sulfonic acid group" and "carboxylic acid groups" are meant to include salts of sulfonic acid or salts of carboxylic acid groups by processes such as hydrolysis. Suitable cation exchange membranes are sold oommercially by E. I. DuPont de Nemours & Co., Inc., under the trademark "Nafion"; by the Asahi Glass Company under the trademark "Flemion"; and by the Asahi Chemical Company under the trademark "Aciplex".

The membrane separator is positioned between the anodes and the cathodes and is separated from the cathode by a cathode-membrane gap which is wide enough to permit the catholyte to flow between the face of the cathode and the membrane from the first catholyte zone to the second catholyte zone, and to prevent gas blinding but not wide enough to substantially increase electrical resistance. Depending on the form of cathode used, the cathode-membrane gap is a distance of from about 0.05 to about 10, and preferably from about 1 to about 4 millimeters. The cathode-membrane gap can be maintained by hydraulic pressure or mechanical means.

Cathodes used in the cathode compartment are porous structures which readily permit the flow of the catholyte solution through the pores or openings of the cathode structure at rates which maintain the desired reaction conditions. Suitable cathodes have at least one layer having a total surface area to volume ratio of greater than 100 $cm^2$ per $cm^3$, preferably 250 $cm^2$ per $cm^3$, and more preferably greater than 500 $cm^2$ per $cm^3$. These structures have a porosity of at least 60 percent and preferably from about 70 percent to about 90 percent, where oorosity is the percentage of void volume. The ratio of total surface area to the projected surface area of the porous cathodes, where the projected surface area is the area of the face of the cathode, is at least about 30:1 and preferably at least from about 50:1, for example, from about 80:1 to about 100:1.

Employing the novel process of the invention, concentrated alkali metal hydrosulfite solutions are produced having low concentrations of alkali metal thiosulfates as an impurity in electrolytic membrane cells operating at high current densities, substantially reduced cell voltages, and high current efficiencies.

The following examples further illustrate the process of the present invention without the intention of being limited thereby.

EXAMPLE 1

An electrochemical cell of the type shown in FIGS. 1-2 was employed. In the cathode compartment a porous cathode of 304 stainless steel felt metal (0.318 cm. thick) having a porosity of 80 percent, a projected surface area of 206 $cm^2$, and a total surface to volume ratio of 320 $cm^2$ per $cm^3$ was mounted. A sheet of 316 stainless steel was attached to the back of the porous cathode to divide the cathode chamber into a first catholyte zone and a second catholyte zone. A current conductor was mounted on the stainless steel barrier. A cation exchange membrane (Nafion® 906, manufactured by E. I. DuPont de Nemours & Co., Inc.) was mounted in the cell spaced apart from the face of the porous cathode by 2 to 3 mm. An aqueous electrolyte solution containing an average concentration of 75 gpl of sodium bisulfite and 25 gpl sodium sulfite, produced by feeding $SO_2$ gas into an aqueous $NaHSO_3$ solution was initially fed to the first catholyte zone and continuously circulated through the cathode compartment. The flow of catholyte through the inlet was directed at the bottom backside of the porous cathode where it flowedbbelow the barrier and through the porous cathode into the cathode-membrane gap. The catholyte flowed along the membrane, past the barrier and then back through the porous cathode into the second catholyte zone and out the outlet. The catholyte was circulated at a rate of 0.5 liter per minute, and sulfur dioxide continuously added to replenish the catholyte pH. The catholyte was maintained at 5.6±0.1. The anode contained an anode formed of vertically positioned nickel rods. A polypropylene mesh separator was placed between the face of the anode and the membrane. An aqueous solution of NaOH (30 percent by weight) was fed to the anode compartment and circulated at a rate of 0.5 liter per minute. A current density of 2.0 $KA/m^2$ was applied to the electrodes. The cell operated for a period of 69 days at a cell voltage in the range of 2.8 to 3.4 volts. The sodium hydrosulfite solution produced had an average concentration of 145 grams per liter (gpl) of $Na_2S_2O_4$, 75 gpl of $NaHSO_3$, 25 gpl $Na_2SO_3$, and 7 gpl of $Na_2S_2O_3$. The current efficiency averaged 90 percent.

EXAMPLE 2

The electrolytic membrane cell of EXAMPLE 1 was employed using a stainless steel felt metal cathode having a porosity of 85 percent and a projected surface area of 206 $cm^2$ with a total surface area to volume ratio of 750 $cm^2$ per $cm^3$. The cation exchange membrane was Nafion ®906 (manufactured by E. I. DuPont de Nemours & Co., Inc.). The initial catholyte contained an average of 80 gpl of $NaHSO_3$ and 18 gpl of $Na_2SO_3$. During operation, sulfur dioxide and water were added to maintain these buffer concentrations. Sodium hydroxide and water were added to the anode compartment during operation to maintain an average concentration of 15 percent by weight of NaOH. The cell was operated at the same circulation rates as EXAMPLE 1 and at a current density of 2.25 $KA/m^2$ for a period of 48 days to produce a sodium hydrosulfite solution having an average concentration of 155 gpl of $Na_2S_2O_4$ and 5 gpl of $Na_2S_2O_3$. The cell voltage was in the range of 2.7 to 3.1 volts and the current efficiency was approximately 90 percent.

EXAMPLE 3

The electrolytic membrane cell of EXAMPLE 1 was employed using 430 stainless steel felt metal cathode having a projected surface area of 206 $cm^2$, a total surface area to volume ratio of 146 $cm^2$ per $cm^3$, and a porosity of 80 percent and a titanium expanded mesh anode. The anolyte was a brine containing 25 percent by weight of NaCl and, as the initial catholyte, a solution of 90 gpl of $NaHSO_3$ which was circulated at 0.6 liter per minute. At a current density of 1.5 $KA/m^2$, the cell operated at 3.78 volts to producea sodium hydrosulfite solution containing 147.5 gpl $Na_2S_2O_4$, 7.2 gpl $NaHSO_3$, 12.1 gpl $Na_2SO_3$, and 8.9 gpl $Na_2S_2O_3$. During cell operation the pH of the catholyte was maintained at 5.6±0.2 by adding sulfur dioxide to the circulating catholyte. The cell temperature was 27° C. The overall cell current efficiency was 88 percent.

EXAMPLE 4

The cell of EXAMPLE 3 was modified to use a nickel metal felt cathode having a porosity of 70 percent and a total surface area to volume ratio of 765 $cm^2$ per $cm^3$. The cell operated at a current density of 2.0 $KA/m^2$ and a cathode voltage of 4.48 volts. At a cell temperature of 23° C., a product solution containing 132.2 gpl of $Na_2S_2O_4$, 90.6 gpl $NaHSO_3$, 15.22 gpl $Na_2SO_3$, and 10.2 gpl of $Na_2S_2O_3$ was produced. The cell current efficiency was 85.5 percent.

EXAMPLE 5

The process of EXAMPLE 4 was repeated using the nickel felt metal cathode which was plated with 0.5 g. of silver. The cell was operated at a current density of 2.0 $KA/m^2$ to produce a solution containing 151.5 gpl $Na_2S_2O_4$, 90.4 gpl $NaHSO_3$, 19.5 gpl $Na_2SO_3$, and 8.6 gpl of $Na_2S_2O_3$. The cell voltage was 4.74 volts and the current efficiency was 90 percent.

EXAMPLE 6

The electrolytic membrane cell of EXAMPLE 3 was employed using as the cathode a 347 stainless steel felt metal having a total surface area to volume ratio of 1,322 $cm^2$ per $cm^3$ and a porosity of 70 percent. The cell was operated at a current density of 2.0 $KA/m^2$ and a cell voltage of 4.1 volts to produce an aqueous hydrosulfite oolution containing 134.5 gpl $Na_2S_2O_4$, 78 gpl $NaHSO_3$, 9.3 gpl $Na_2SO_3$, and 6.8 gpl $Na_2S_2O_3$. The overall cell current efficiency was 91 percent.

What is claimed is:

1. A process for the electrochemical production of an alkali metal hydrosulfite by the reduction of an alkali metal bisulfite component of a circulated aqueous catholyte solution in an electrolytic membrane cell having a cathode compartment, a porous cathode in the cathode compartment, an anode compartment and a cation exchange membrane separating the cathode compartment from the anode compartment, which process comprises passing at least 30 percent by volume of said aqueous catholyte twice through the porous cathode, the first pass being in one direction through a first section of the porous cathode and the second pass in a generally opposite direction through a second section of the porous cathode.

2. The electrochemical process of claim 1 in which the alkali metal bisulfite is sodium bisulfite or potassium bisulfite; and the corresponding alkali metal hydrosulfite is sodium hydrosulfite or potassium hydrosulfite.

3. The electrochemical process of claim 2 in which at least 50 percent by volume of the aqueous solution of alkali metal bisulfite is passed through the porous cathode.

4. The electrochemical process of claim 3 in which the pH of the aqueous catholyte solution is maintained at from about 5.0 to about 6.5.

5. The electrochemical process of claim 4 in which the cell temperature is maintained in the range of from about 0° to about 35° C.

6. The electrochemical process of claim 5 in which the current density is in the range of from about 1.0 to about 4.5 kiloamps per square meter.

7. The electrochemical process of claim 6 in which the aqueous catholyte solution of alkali metal hydrosulfite contains an alkali metal thiosulfate in concentrations of from 0 to about 10 percent by weight of the alkali metal hydrosulfite.

8. The electrochemical process of claim 2 in which an aqueous solution of an alkali metal hydroxide or an alkali metal halide is fed to the anode compartment.

9. The electrochemical process of claim 2 in which the product portion of the aqueous solution of alkali metal hydrosulfite has a concentration of from about 120 to about 160 grams per liter of $Na_2S_2O_4$.

10. The electrochemical process of claim 1 in which at least 70 percent by volume of the aqueous catholyte solution is passed through the porous cathode.

* * * * *